250-507.1 SR

OR 3,971,955

United State

Heyer et al.

3,971,955

July 27, 1976

[54] SHIELDING CONTAINER

[75] Inventors: Robert E. Heyer, Hopatcong; Bernard J. Bolter, Trenton, both of N.J.

[73] Assignee: E. R. Squibb & Sons, Inc., Princeton, N.J.

[22] Filed: Aug. 14, 1975

[21] Appl. No.: 604,752

[52] U.S. Cl. ..... 250/507; 220/17

[51] Int. Cl.[2] ..... G21F 5/00

[58] Field of Search ..... 250/506, 507; 220/17; 206/446

[56] References Cited

UNITED STATES PATENTS

| | | | |
|---|---|---|---|
| 2,664,998 | 1/1954 | Gifford | 250/507 |
| 2,915,640 | 12/1959 | Grubel et al. | 250/507 |
| 3,531,644 | 9/1970 | Koster | 250/507 |
| 3,882,315 | 5/1975 | Soldan | 220/17 |

*Primary Examiner*—Harold A. Dixon
*Attorney, Agent, or Firm*—Lawrence S. Levinson; Merle J. Smith; Stephen B. Davis

[57] ABSTRACT

Container for use in the shipment and storage of radioactive material including a wrench-type cover. The cover includes a lid and a wrench-type attachment dimensioned so as to engage the cap of an enclosed bottle and provide space in which an absorbent pad can be located.

10 Claims, 6 Drawing Figures

SHIELDING CONTAINER

BACKGROUND OF THE INVENTION

The increasing use of radioactive isotopes for the diagnosis and treatment of various medical conditions in recent years has resulted in the need for containers capable of storing and shipping these materials without endangering those who must handle them in transit and in administration.

Grubel et al. in U.S. Pat. No. 2,915,640 disclose a cylindrical container having a squared bottom recess adapted to hold a square shaped bottle containing radioactive material. The container has a lid whose inner surface is adapted to conform to the cap of the enclosed bottle. When the lid is rotated the bottle cap is unscrewed but remains on the bottle from which it is later removed by tongs.

Koster in U.S. Pat. No. 3,531,644 discloses a cylindrical receptacle housing a vessel with a pierceable cap containing liquid radiopharmaceuticals. A piece of cushioning and absorbing material is located between the bottom of the vessel and the outer receptacle. Also, a retaining ring is employed to hold the vessel in place.

SUMMARY OF THE INVENTION

This invention relates to improvements over the radiopharmaceutical containers described above. It relates to a container having a wrench-type lid which will both unscrew and remove the cap from the enclosed bottle and provide means to absorb any radioactive material which might leak from the enclosed bottle. Also, the same container with a minor modification may be used with bottles having a pierceable cap.

DETAILED DESCRIPTION

Figure 3:
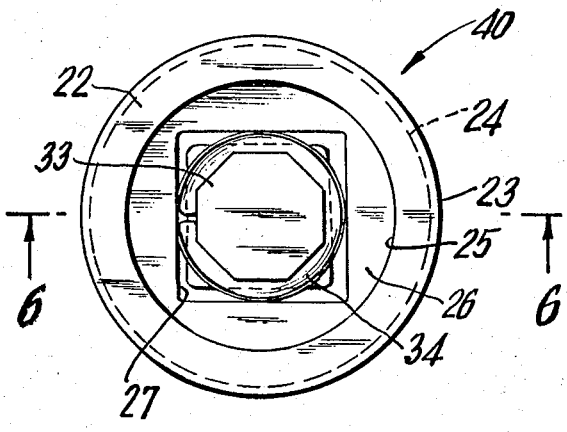
FIG. 3 is a top view of the cylindrical container body housing a bottle containing radioactive material.
Figure 6:
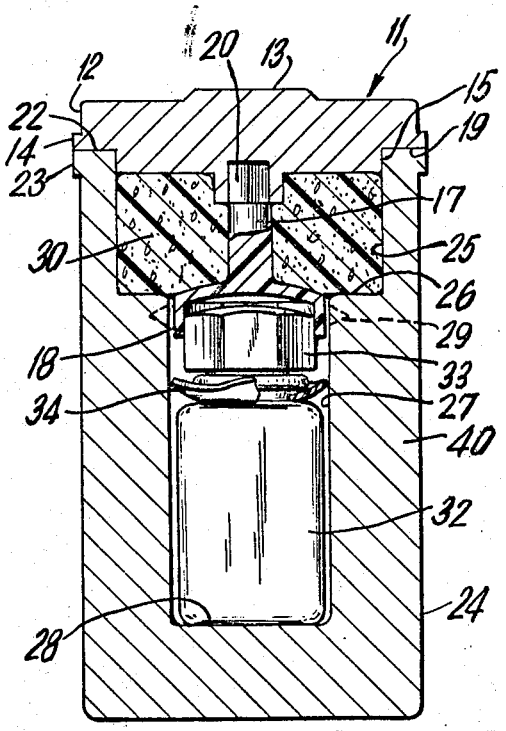
FIG. 6 is a front view of the assembled container taken along the line 6—6 of FIG. 3.

Referring now to the drawings in more particular detail, the shielding container 10 comprises cover 11 and cylindrical body 40 in which a bottle 32 containing radioactive isotopes is housed (see FIG. 6). In the preferred embodiment of this invention the bottle 32 has a screw type cap 33. The cap 33 is of a polygonal configuration with the octagonal shape shown in the figures being preferred (see FIGS. 3 and 6).

Figure 1:
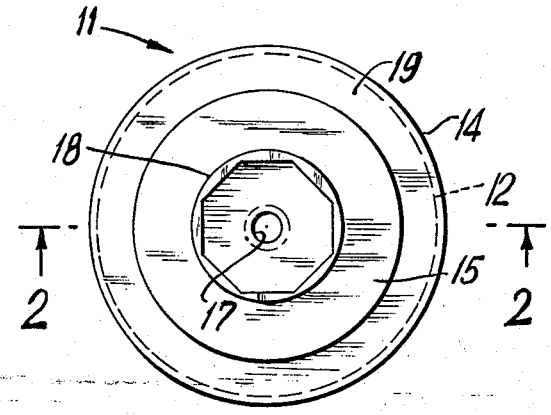
FIG. 1 is a top view of the inverted container cover.
Figure 2:
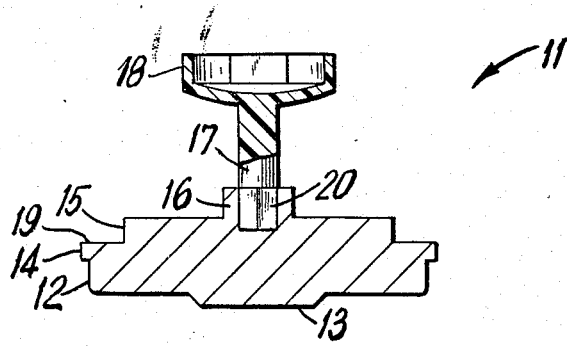
FIG. 2 is a front view of the container cover taken along the line 2—2 of FIG. 1.

The cover 11 comprises a lid and a wrench type attachment. Thus, the cover includes a disk member 12 having a depending member 17 and a cap cover 18. The cap cover 18 is of the same polygonal shape as the screw type bottle cap 33 and is dimensioned so as to snuggly fit over the bottle cap (see FIGS. 1 and 6). The lid can include a flange 14 to aid in attaching the cover to the container body and an inner disk member 15 concentric with but of smaller diameter than disk 12 which sits within the container body and aids in positioning of the cover (see FIGS. 2 and 6). The entire cover can be constructed as a single unit. However, since the lid portion of the cover must be formed of shielding material such as lead, it is preferable to form the cover as two units. The first unit comprises the lid formed of shielding material and the second unit comprises the wrench attachment formed from light weight material such as rigid polyethylene or polypropylene or other similar substances. The depending member 17 can be adhesively attached to the surface of the disk 15 or as shown in FIG. 2 the disk 15 can include an extension 16 and a hole 20 in which the member 17 is force fit. The raised surface 13 merely provides extra shielding in the area of the hole 20. Also, this two unit construction enables the lid portion to be reused with wrench attachments having a member 18 of polygonal shapes other than octagonal should bottles having different shaped caps be used.

The cylindrical container 40 is formed with a squared off well bounded by side wall 27 and bottom wall 28 in communication with an upper recess bounded by side wall 25 and ledge 26. The upper recess is of a cylindrical shape and of slightly larger diameter than disk 15 of the lid (see FIG. 6). The outer container body 24 can also include a flange 23 to aid in attaching the cover to the container body. The container body 40 is preferably formed as a single unit and from a radioactive shielding material such as lead. Also, in order to reduce friction, either surface 19 of the cover or surface 22 of the container body can have a polymer film coating.

Figure 4:
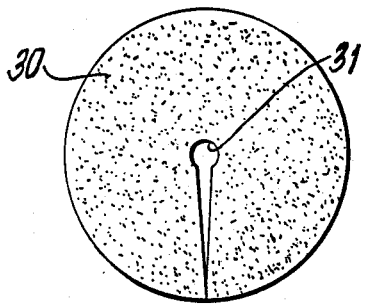
FIG. 4 is a top view of the absorbent pad.

FIG. 4 is a top view of absorbent pad 30 which encircles depending member 17 and fills the upper recess of the container body above the cap cover 18 (see FIG. 6). The pad 30 can be formed of any absorbent, flexible, resilient material with open cell polyurethane foam being preferred. The pad is of a cylindrical split ring shape and is dimensioned so as to snuggly fit in the upper recess of container body 40 with the inner hole and split 31 enabling the pad to be easily placed around member 17.

Figure 5:
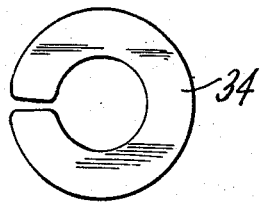
FIG. 5 is a top view of the retaining ring.

FIG. 5 is a top view of split retaining ring 34 which is dimensioned to fit around the neck of bottle 32. The retaining ring is formed from flexible plastic material such as polyethylene or polypropylene and its outer dimension is slightly greater than the opening of the well in the container body.

The shielding container is employed as follows. The retaining ring 34 is placed around the neck of square shaped bottle 32 containing orally active liquid radiopharmaceutical material sealed by means of screw cap 33. The bottle and retaining ring are forced into the squared off well in the container body 40. The cover 11 including disk lid 12, depending member 17 surrounded by absorbent pad 30, and cap cover 18 is lowered into the container body and rotated until the cap cover 18 engages screw cap 33. The container is sealed by wrapping a piece of plastic stretch tape around the area of flanges 14 and 23. When the contents of bottle 32 are to be used, the stretch tape is removed and the lid is rotated counterclockwise causing the screw cap 33 to also rotate while the squared off sides of the well prevent the bottle from rotating. The lid 11 is lifted also lifting the loosened cap 33 and exposing the contents of the bottle. Should there have been leakage of radioactive material from the bottle during shipping, such material would have been absorbed by pad 30 and will not pose a danger to the technician or patient. This leaves the orally active radiopharmaceutical material within the shielding container body ready for use without any further preparation aside from inserting a drinking straw.

This container with minor modification can also be employed for the shipping of liquid parenteral radiopharmaceutical substances. Such materials are conventionally placed in bottles having a pierceable cap. This type of cap is usually crimped onto the bottle and therefore cannot be removed by rotation. When shipping such bottles in the container of the instant invention, it is no longer necessary that the cap cover 18 be of the same geometric configuration as the bottle cap but only that the cover 18 fit loosely over the pierceable cap. Grooves 29 are cut into the side walls 27. As described above, the retaining ring 34 is placed around the neck of the bottle. The bottle and retaining ring are forced into the well causing the ring to deform. The cover including the absorbent pad is then inserted and the container is sealed. When the contents of the bottle are to be used, the seal is removed and the cover is lifted. The container body is inverted and the pierceable cap is punctured by a syringe. During this operation, movement of the bottle is prevented since the retaining ring 34 will lock into grooves 29 and hold the bottle in place. In this embodiment, the cap cover 18 aids in holding the bottle in place during shipment and the pad absorbs any leaks which may have occurred.

What is claimed is:

1. A shielding container for radiopharmaceuticals comprising a cover and a cylindrical body wherein said cover includes a disk shaped lid having a depending member and cap cover, said cylindrical body is formed with a squared off well and an outer recess communicating with said well, a sealed bottle containing radiopharmaceutical material having a retaining ring located around its neck is located in said well, said cap cover contacting the bottle cap, and a pad of absorbent, flexible, resilient material located around said depending member and filling said outer recess.

2. The container of claim 1 wherein said outer recess is cylindrical and said pad is cylindrical with an inner hole and split so as to enable the pad to be placed around the depending member.

3. The container of claim 2 wherein said disk shaped lid and said cylindrical body both have an outwardly extending flange and said container is sealed in the area where said flanges meet.

4. The container of claim 3 wherein said cover includes a second inner disk concentric but of smaller diameter than the first dimensioned to sit within the container body and wherein said depending member is attached to said second disk.

5. The container of claim 4 wherein both of said lid disks and said cover flange are formed as a single unit and said depending member and cap cover are formed as a second unit and the smaller disk includes a centrally located hole into which the top of the depending member is force fit.

6. The container of claim 5 wherein said lid disks and cover flange and said cylindrical container body and body flange are formed of lead, said depending member and cap cover are formed of rigid polymeric material, and said retaining ring is formed of semi-rigid deformable polymeric material.

7. The container of claim 6 wherein said absorbent pad is formed of polyurethane foam.

8. The container of claim 7 wherein said bottle is sealed by a screw type cap, said bottle cap and said cap cover are both of the same polygonal shape, and said cap cover is dimensioned to engage said bottle cap so that rotation of the container cover will in turn rotate and unlock the cap and the cap will be lifted and removed by lifting the container cover.

9. The container of claim 8 wherein said screw type cap and said cap cover are both octagonal.

10. The container of claim 7 wherein said bottle is sealed by a non-rotatable pierceable cap, grooves are located in the side walls of said well and the retaining ring locks into said grooves, and said cap cover is dimensioned to fit loosely over said pierceable cap.

* * * * *